US009826874B2

(12) United States Patent
Franke et al.

(10) Patent No.: US 9,826,874 B2
(45) Date of Patent: Nov. 28, 2017

(54) HAND-GUIDED FLOOR TREATMENT DEVICE

(71) Applicant: i-mop GmbH, Bensheim (DE)

(72) Inventors: Rudolf Franke, Bensheim (DE); Rainer Kenter, Guenzburg (DE)

(73) Assignee: i-mop GmbH, Bensheim (DE)

( * ) Notice: Subject to any disclaimer, the term of this patent is extended or adjusted under 35 U.S.C. 154(b) by 455 days.

(21) Appl. No.: 14/448,570

(22) Filed: Jul. 31, 2014

(65) Prior Publication Data

US 2015/0113757 A1 Apr. 30, 2015

(30) Foreign Application Priority Data

Aug. 2, 2013 (DE) ..... 10 2013 215 198

(51) Int. Cl.
*A47L 11/40* (2006.01)
*A47L 11/26* (2006.01)
(Continued)

(52) U.S. Cl.
CPC ..... *A47L 11/4088* (2013.01); *A47L 7/0023* (2013.01); *A47L 11/26* (2013.01);
(Continued)

(58) Field of Classification Search
CPC .... A47L 11/4088; A47L 7/0023; A47L 11/26; A47L 11/305; A47L 11/4016;
(Continued)

(56) References Cited

U.S. PATENT DOCUMENTS 2,558,590 A * 6/1951 Smith ..... A47L 11/34 15/320
2,818,312 A * 12/1957 Arones ..... A47L 11/4075 15/22.1

(Continued)

FOREIGN PATENT DOCUMENTS

DE 1 205 664 B 11/1965
DE 24 43 969 A1 4/1976

(Continued)

OTHER PUBLICATIONS

German-language European Search Report dated Dec. 15, 2014 with partial English translation (eight pages).

(Continued)

*Primary Examiner* — Robert Scruggs
(74) *Attorney, Agent, or Firm* — Crowell & Moring LLP

(57) ABSTRACT

A hand-guided floor treatment device includes a bottom part, which includes at least one tool which is rotatable on a floor by a drive, as well as a guide part which includes at least one handle and is connected to the bottom part by an articulated arrangement which is developed in such a manner that the guide part, proceeding from a perpendicular, is pivotable in relation to the perpendicular in angular positions rotating in all directions and is operatively connected to the bottom part so as to transmit torque in an angularly limited manner in each angular position in relation to the perpendicular. The at least one rotatable tool is arranged in such a manner on the bottom part that when the floor treatment device is operating the at least one rotatable tool exerts permanent linear propulsion on the bottom part.

19 Claims, 7 Drawing Sheets

(51) Int. Cl.
*A47L 11/30* (2006.01)
*A47L 7/00* (2006.01)

(52) U.S. Cl.
CPC ..... *A47L 11/305* (2013.01); *A47L 11/4016* (2013.01); *A47L 11/4063* (2013.01); *A47L 11/4066* (2013.01); *A47L 11/4072* (2013.01); *A47L 11/4075* (2013.01); *A47L 11/4083* (2013.01); *A47L 11/4091* (2013.01)

(58) Field of Classification Search
CPC ..... A47L 11/4063; A47L 11/4066; A47L 11/4072; A47L 11/4075; A47L 11/4083; A47L 11/4091
See application file for complete search history.

(56) References Cited

U.S. PATENT DOCUMENTS

| | | | | |
|---|---|---|---|---|
| 3,013,287 | A * | 12/1961 | Descarries | A47L 11/4072 15/410 |
| 4,334,337 | A | 6/1982 | Miller et al. | |
| 4,542,556 | A | 9/1985 | Hepple | |
| 5,237,719 | A * | 8/1993 | Dwyer, Jr. | A47L 11/34 15/320 |
| 2004/0134016 | A1 * | 7/2004 | Kisela | A47L 5/24 15/320 |
| 2007/0209138 | A1 * | 9/2007 | Tran | A47L 5/225 15/320 |
| 2008/0216279 | A1 * | 9/2008 | Jeff | A47L 11/302 15/320 |
| 2010/0107347 | A1 | 5/2010 | Vernazza | |
| 2010/0251513 | A1 | 10/2010 | Pryor et al. | |
| 2012/0110775 | A1 * | 5/2012 | Krebs | A47L 9/0422 15/347 |
| 2012/0233804 | A1 | 9/2012 | Studebaker et al. | |
| 2012/0279010 | A1 | 11/2012 | Kenter et al. | |
| 2013/0269127 | A1 * | 10/2013 | Estep | A47L 15/37 15/21.1 |

FOREIGN PATENT DOCUMENTS

| | | | |
|---|---|---|---|
| DE | 30 18 645 | A1 | 11/1981 |
| DE | 86 30 341 | U1 | 1/1987 |
| DE | 87 00 123 | U1 | 4/1987 |
| DE | 295 02 611 | U1 | 6/1995 |
| DE | 103 14 379 | A1 | 10/2004 |
| FR | 1 025 236 | A | 4/1953 |
| GB | 2 184 965 | A | 7/1987 |
| GB | 2489056 | A | 9/2012 |
| WO | WO 2004/062457 | A2 | 7/2004 |
| WO | WO 2011/023169 | A2 | 3/2011 |

OTHER PUBLICATIONS

European Search Report issued in counterpart European Application No. 14177128.7 with partial English translation dated Sep. 23, 2015 (13 pages).

* cited by examiner 5
4
H1
6
H2
G2
G1
3
9

5
22
4
6
G1
G2
12

1
3
8
11

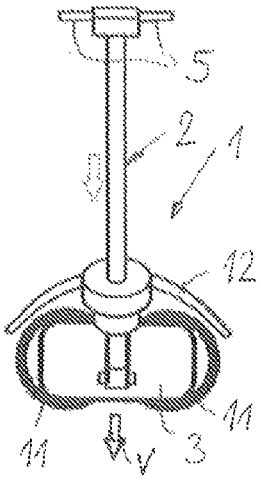
Fig. 9
Fig. 10
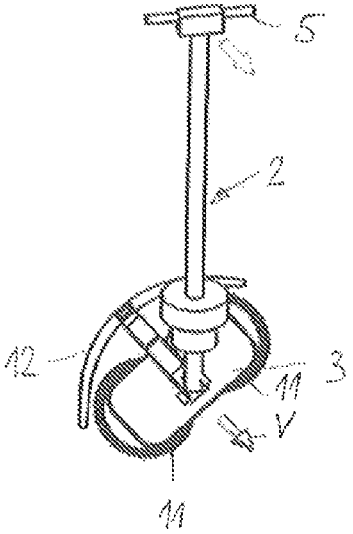
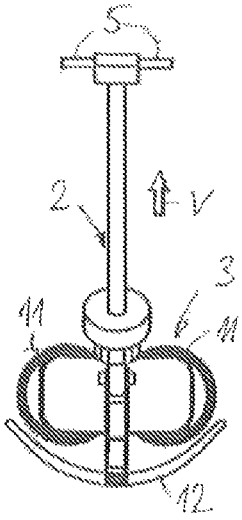
Fig. 11
Fig. 12
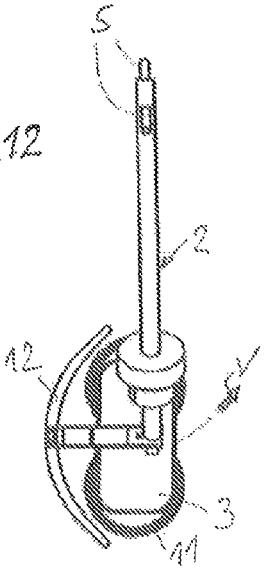
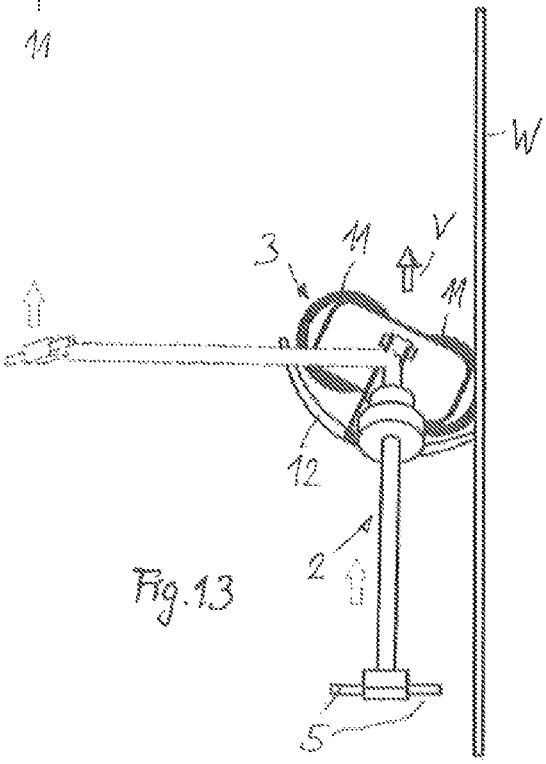
Fig. 13

HAND-GUIDED FLOOR TREATMENT DEVICE

CROSS-REFERENCE TO RELATED APPLICATIONS

This application claims the priority of the German patent application DE 102013215198.5, the disclosure of which is hereby incorporated into this application.

BACKGROUND AND SUMMARY OF THE INVENTION

The invention relates to a hand-guided floor treatment device having a bottom part which includes at least one tool which is rotatable on a floor by means of a drive, as well as having a guide part which includes at least one handle and is connected to the bottom part by means of an articulated arrangement which is developed in such a manner that the guide part, proceeding from a perpendicular, is pivotable in relation to the perpendicular in angular positions rotating in all directions and is operatively connected to the bottom part so as to transmit torque in an angularly limited manner in each angular position in relation to the perpendicular.

A floor treatment device of this type is known from WO 2011/023169 A2. The known floor treatment device provides a scrubber-drier machine which is provided for the wet cleaning of floors. The scrubber-drier machine comprises a guide part which has two handles and can be gripped and moved by one operator using two hands. The guide part is connected to a bottom part by means of an articulated arrangement, the articulated arrangement being developed in such a manner that the guide part can be pivoted in relation to the bottom part in an angularly restricted manner rotating in all directions and can nevertheless transmit a torque to the bottom part. The bottom part comprises two rotatable, plate-shaped tools which are driven. The two plate-shaped tools have associated therewith a suction strip arrangement which, with the scrubber-drier machine in the operating position, rests on a floor by means of sealing lips and serves for sucking up a dirty water detergent solution.

It is the object of the invention to create a floor treatment device of the type mentioned in the introduction which makes further simplified operation possible compared to the prior art.

Said object is achieved for a floor treatment device of the type mentioned in the introduction in that the at least one rotatable tool is arranged in such a manner on the bottom part that when the floor treatment device is operating the at least one rotatable tool exerts permanent linear propulsion on the bottom part. The at least one tool is rotatable exclusively in the direction of propulsion. An operator consequently no longer has to pull or push the floor treatment device according to the invention into the corresponding direction of treatment, as is the case in the prior art. Rather, the operator simply just has to control the automatically progressing bottom part. As a result of the articulated arrangement, it is particularly simple for one operator to control the floor treatment device since a simple rotational movement introduced manually by means of the at least one handle onto the guide part in each angular position of the guide part relative to the bottom part ensures a corresponding transmission of torque to the bottom part such that the direction of the bottom part is able to be modified by controlling the guide part. As a result, an extremely small amount of force is necessary to control the floor treatment device. On account of the large degree of mobility of the guide part in relation to the bottom part, it is also possible and simple to treat floors in areas that are difficult to access. The solution according to the invention is provided for both dry operating floor treatment devices and wet operating floor treatment devices. Both tools with an approximately vertically aligned axis of rotation and tools with an approximately horizontally aligned axis of rotation are provided as rotatable tools. Essential to the invention is that the at least one rotatable tool is arranged in such a manner in relation to the bottom part that in operation linear propulsion of the bottom part is produced by the tool rotating on the floor. This means that, when the at least one tool is operating, the bottom part is permanently moved forward in a straight line as long as no controlling operation is introduced by correspondingly pivoting the guide part. If at least one rotatable tool is provided in the form of a roller or brush which is mounted in the bottom part with a horizontal axis of rotation, rotation of the at least one tool in the direction of propulsion inevitably causes the bottom part to move forward in a linear manner. One single brush-shaped or roller-shaped tool is preferably provided. As an alternative to this, at least two roller-shaped or brush-shaped tools each with a horizontal axis of rotation can be arranged side by side or one behind another. Correspondingly linear propulsion is brought about in the case of said alternative as a result of synchronized drive control of the at least two tools. Where the tools are arranged one behind another with a horizontal axis of rotation, they can also rotate in opposite directions as long as a resultant propulsive force acting on the floor is achieved for the bottom part. In particular, it is possible for one tool to act on the floor with greater force or higher rotational speed than the other tool, the first tool then having to rotate in the direction of propulsion. In the case of tools with an approximately vertical axis of rotation, at least two tools are provided, in particular in the form of discs, which are rotatable in opposite directions with respect to one another and are slightly inclined with respect to a horizontal plane in order to achieve the desired linear propulsion function as a result of uneven rotational friction of each disc on a corresponding floor. In an advantageous manner, the two preferably plate-shaped tools are inclined by identical angular amounts in a mirror-symmetrical manner with respect to a vertical centre longitudinal plane of the bottom part and are actuated in opposite directions at synchronized drive speeds in order to obtain the desired linear propulsion.

In a development of the invention, the floor treatment device is realized as a wet cleaning machine, in particular as a scrubber-drier machine, and comprises a suction strip arrangement which—when viewed in the direction of propulsion—is arranged behind the rotatable tool and in operation rests on the floor. The suction strip arrangement includes at least one sealing lip which extends over a treatment width of the bottom part and rests on the floor. Two sealing lips, which are spaced apart substantially parallel to one another, are preferably provided, between which a corresponding suction action is generated as a result of at least one intake of a suction system of the wet cleaning machine. The suction strip arrangement is preferably curved in an arcuate manner. The suction strip arrangement can also include several suction strip portions which are arranged side by side or one behind another. According to the invention, only one single suction strip arrangement is provided which is realized as a single part or multiple parts and is arranged behind the at least one rotatable tool. As the at least one rotatable tool exerts permanent linear propulsion when the wet cleaning machine is operating, it is ensured that the desired cleaning action is obtained permanently as a result of a simple, automatic forward movement of the bottom part. The automatically progressing bottom part is controlled by means of the hand-guided guide part. In the case of the wet cleaning machine according to the invention, fresh water with or without cleaning additives which supports a corresponding scouring or scrubbing operation by the at least one rotating tool, is first of all supplied in the region of the at least one rotatable tool. The dirty water generated is then sucked up behind the at least one rotating tool by the following suction strip arrangement and is discharged into a dirty water tank.

In a further development of the invention, the articulated arrangement includes at least two articulated axes which differ from one another, are in particular orthogonal to one another and are aligned in each case differently, in particular orthogonally with respect to a vertical axis of the guide part. The vertical axis of the guide part is to be understood as a centre longitudinal axis in the longitudinal extension of the guide part which, with the guide part aligned perpendicularly in relation to a floor and in relation to the bottom part, extends in the vertical direction of the floor treatment device. In an advantageous manner, the two articulated axes are aligned orthogonally with respect to one another. In order to ensure that it is possible to transmit torque to the bottom part in each angular position of the guide part in relation to the perpendicular, the articulated axes have also to be aligned differently, in particularly orthogonally with respect to the vertical axis of the guide part. This ensures that when the guide part is rotated about its vertical axis, which is brought about manually, torque is transmitted to the bottom part in every angular position of the guide part in relation to the bottom part. The possibility of the guide part transmitting torque to the bottom part is limited to angular positions of the guide part in relation to the perpendicular of less than between 45 and 50°. The articulated axes can be present physically as a result of corresponding mechanical articulated developments. As an alternative to this, the articulated axes can also be provided in a virtual or imaginary manner inside at least one corresponding solid articulation which forms the articulated arrangement.

In a further development of the invention, the at least two articulated axes are spaced apart from one another in the direction of the vertical axis of the guide part. In a further development, weight distribution of the guide part is displaced downward toward the upper articulated axis. In an advantageous manner, a mass centre of gravity of the guide part in the standby state is arranged in the region of an upper articulated axis or below the upper articulated axis. A standby state exists when the scrubber-drier machine is filled with fresh water (cleaning water) ready for operation and the guide part is situated in an upright operating position (at an angle of between 0° and 45° with respect to a perpendicular). Weight distribution of corresponding components inside the guide part is developed such that the mass centre of gravity of the guide part is situated in a bottom half of the guide part—with reference to an entire longitudinal extension of the guide part. Displacing the mass centre of gravity into the lower half of the guide part makes it possible for a large part of the weight of the guide part to be supported in the region of the articulated arrangement. As a result, the operator needs a substantially smaller holding force for the guide part in the upper region of the guide part, which includes the at least one handle, than would be the case if a distribution of the weight of the guide part had been displaced further upward.

In a further development of the invention, a bottom operational portion of the guide part flanks the articulated arrangement at least in part. In an advantageous manner, the bottom operational portion is positioned—when viewed in the direction of propulsion—in front of the articulated arrangement such that with the guide part in a corresponding rearwardly inclined position, the operational portion is supported in the region of the upper articulated axis. The manageability of the floor treatment device for an operator is further improved as a result. A corresponding operational portion can be a fresh water and/or dirty water tank which is relatively heavy in the filled state. As an alternative to this, it is provided according to a further development to provide a suction drive for the suction strip arrangement, in particular a suction turbine, as the lower operational portion of the guide part. The suction drive is also relatively heavy such that as a result of the arrangement of the suction drive in the bottom region of the guide part, there is a distribution of weight that is also displaced toward the articulated arrangement. The displacement of the suction drive into the guide part also enables a simplified development of the bottom part, with which then substantially only the at least one rotatable tool, an associated rotational drive and the suction strip arrangement are still associated.

In a further development of the invention, in the normal operating position the bottom part is supported on the floor—when viewed in the direction of propulsion—at the front by means of the at least one rotatable tool and at the rear by means of the suction strip arrangement, and the articulated arrangement is pivotally mounted in a working region on the bottom part in such a manner that an overall weight of the floor treatment device is distributed in a uniform or front-heavy manner onto the front and the rear support of the bottom part on the floor. The articulated arrangement cooperates accordingly with a point on the bottom part which introduces the weight of the guide part on the bottom part such that a defined distribution of the overall weight of the floor treatment device is produced onto the front support in the region of the at least one rotatable tool on the one hand and onto the rear support in the region of the suction strip arrangement on the other hand. A uniform weight distribution means that at least extensively half is distributed onto the front and half onto the rear support. A front-heavy weight distribution means that more than 55% up to a maximum of 90% of the overall weight is supported in the region of the at least one rotatable tool. The described distribution ratios ensure a good cleaning force as a result of the at least one rotatable tool. The at least one rotatable tool and the suction strip arrangement are all that is necessary for supporting the bottom part on the floor.

In a further development of the invention, the suction strip arrangement has associated therewith at least one floor spacer which is in particular movable in a rolling or sliding manner and, in addition to at least one sealing lip of the suction strip arrangement, brings about support of the bottom part on the floor. The floor spacer ensures that, when placed on a floor, bending of the at least one sealing lip is limited. Defined as a result of this, the sealing lip is always curved at an identical angle, as a result of which a particularly good sealing action is produced irrespective of the quality of the surface of a floor. This ensures that the at least one sealing lip is not subject to any premature wear as a result of overloading. In addition, it is ensured that the sealing lip does not bend too severely. Several rolling or sliding elements, which are provided over the extension of the suction strip arrangement, can be provided as floor spacers. As an alternative to this, a front sealing lip of the suction strip arrangement can be developed in a more rigid manner and thus assume the function of a floor spacer which slides along the floor in front of the actual sealing lip. Said front sealing lip does not bend but is rigid in the vertical direction. In a particularly advantageous manner, the at least one floor spacer is arranged so as to be vertically adjustable. As a result, the pressing face area of the at least one sealing lip on the floor is able to be modified.

In a further development of the invention, the working region of the articulated arrangement on the bottom part is adjustable forwards or rearwards in the direction of propulsion of the bottom part. As a result it is possible to vary the weight distribution onto the front and rear support of the bottom part toward the floor.

In a further development of the invention, the bottom part includes a carrier bridge which extends along the direction of propulsion of the bottom part and on which the working region of the articulated arrangement is provided, and which is mounted at the one end on the suction strip arrangement and at the other end in the region of a bearing arrangement of the at least one rotatable tool so as to be pivotable about, in each case, a pivot axis which extends transversely with respect to the direction of propulsion and parallel to the floor. The carrier bridge is supported on the suction strip arrangement on at least two support points which are aligned in a symmetrical manner with respect to a vertical centre longitudinal plane. As a result of said development, the suction strip arrangement and the bearing arrangement, in particular a housing, for the at least one rotating tool are not connected together rigidly but are coupled with one another in an articulated manner. A change in the support in the region of the at least one rotatable tool, in particular as a result of wear on the tool, consequently has no effect on the rear support in the region of the suction strip arrangement and accordingly also no effect on a change in the position of the suction strip arrangement. In a correspondingly reversed manner, a lowering of the suction strip arrangement during the course of the operation of the wet cleaning machine does not lead to inevitable lifting or tilting of the rotatable tool in the region of the front support. For, as a result of the described pivot axes which extend parallel to one another, in this respect the two supports of the bottom part are statically uncoupled from one another toward the floor. This ensures that tilting and inclining movements of the guide part which are introduced by the operator have no effect on the position of the suction strip arrangement. The sucking and sealing action of the suction strip arrangement consequently always remains the same. Along with the guide part which is supported on the carrier bridge by means of the articulated arrangement, where there is an electric motor drive for the at least one rotatable tool as well as an electric motor driven suction drive of the suction system, the carrier bridge also carries at least one energy storage unit, preferably in the form of a battery or accumulator, in a particularly advantageous manner in the form of a lithium-ion battery. The weight of a corresponding battery increases a pressure on the suction strip arrangement and improves the sucking and sealing action thereof.

In a further development of the invention, a flow channel which is associated with a suction system for the suction strip arrangement is arranged in the guide part coaxially or parallel to the vertical axis of the guide part. The concept of said development is to develop the guide part as compactly as possible and to distribute it in a weight-optimized manner about the vertical axis of the guide part. The laying of the flow channel in the region of the vertical axis of the guide part enables a space-saving method of construction. The flow channel can be formed by a flexible hose or a dimensionally stable tube.

In a further development of the invention, the guide part includes a support tube which extends along the vertical axis and in which the flow channel is incorporated. The support tube comprises a dual function by it serving, on the one hand, as a carrier for the further operational components of the guide part and, on the other hand, forming the flow channel of the suction system. Several flow channels of the suction system and/or of a fresh water supply system can also extend in the support tube. In addition, at least one cable channel can be incorporated in the support tube, in particular as a result of co-extrusion. Control and power supply cabling can be laid in said cable channel.

In a further development of the invention, the suction drive is arranged on a lower end region of the support tube. The suction drive is preferably developed as an electric suction turbine which is fastened coaxially on the bottom end region of the support tube and is operatively connected directly to the flow channel which extends in the support tube. This produces a short suction path for the suction turbine such that just small suction losses occur. This ensures a lower energy consumption which enables a small and weight-saving battery.

In a further development of the invention, fresh water and dirty water tanks of the suction system are developed in an elongated manner and flank the support tube on opposite sides. As a result the fresh water and dirty water tanks are also grouped directly around the vertical axis of the guide part. Distributing the fresh water and dirty water tanks on opposite sides of the support tube produces particularly good weight distribution on both sides of the vertical axis of the guide part, which simplifies the handling of the guide part by an operator in a considerable manner. Fresh water is to be understood as cleaning water which is supplied to the at least one tool and can be developed in particular from water and cleaning additives or can be developed as a differently realized cleaning solution.

In an advantageous manner, the suction drive is positioned—when seen in the direction of propulsion of the bottom part—in front of the articulated arrangement such that in the case of the normal straight-on position of the wet cleaning machine, the guide part is set inclinedly rearward and the operator walks behind the bottom part. In said position, the weight of the guide part, in particular of the suction drive, is supported in the region of the upper articulation axis of the articulation arrangement such that a holding and guiding force in the region of the handle of the guide part for a corresponding operator is extremely small. This means that the wet cleaning machine can be handled in a simple and power-saving manner in its operating state.

In a further development of the invention, there is provided on the bottom part at least one support means which supports the bottom part on the floor statically determined in a tilted transport or storage position. As a result, the floor treatment device can be stowed in a space-saving manner in the non-required idle state. Such a park position also ensures that the at least one tool and the suction strip arrangement are relieved of stress, as a result of which less wear is produced.

In a further development of the invention, the at least one supporting means is developed as a support element which can be moved in a sliding or rolling manner. Apart from the support and securement in the non-required idle state (storage position), the at least one sliding or rolling support element consequently also serves for transporting the floor treatment device when said floor treatment device is not situated in its operating state.

In a further development of the invention, with the bottom part in the transport or storage position, the guide part is secured on the bottom part in a force-limited manner by means of at least one securing means in an idle position in which in particular the guide part and the bottom part are supported statically determined in relation to one another in a over-centre position. As a result of said development it is possible to transfer the guide part into a defined idle position in relation to the bottom part. The force-limited securement by means of the securing means ensures that the guide part is able to be released again from the bottom part in a simple manner using a small amount of force in order to transfer the bottom part and the guide part into the operating position. In an advantageous manner, with the floor treatment device in the idle position, the guide part and the bottom part are supported statically determined in relation to one another in an over-centre position. This means that the guide part is pivoted by means of the at least one articulated axis of the articulated arrangement in relation to the bottom part so far over the bottom part that the mass centre of gravity of the guide part is positioned above the bottom part.

In a further development of the invention, the at least one securing means is effective in a positive locking or non-positive locking manner. The at least one securing means can be effective mechanically in a positive locking or non-positive locking manner. As an alternative to this it is provided that the positive locking is generated by the at least one securing means as a result of magnetic force. A securing means which is effective mechanically in a positive locking or non-positive locking manner can be realized by a releasable latching connection, by a Velcro fastener or an adhesive closure that is developed in another manner. Where the positive locking action of the securing means is as a result of magnetic force, a permanent magnet is preferably provided on the guide part or on the bottom part, opposite which a magnetizable face, in particular a metal face, is provided as a corresponding counterpart on the bottom part or on the guide part. The advantage of a securing means developed as a magnetic securing means is that the magnetic forces are relatively high in the direction of corresponding magnetic lines of force, with a movement of the guide part in relation to the bottom part transversely with respect to said magnetic lines of force, in contrast, the magnetic securing means is able to be released simply by using little force.

The invention also relates to a floor treatment system having a hand-guided floor treatment device as has been described beforehand, as well as having a storage truck which comprises at least one exchangeable and filled fresh water tank as well as at least one receiving means for a filled dirty water tank or/and a dirty water receiving vessel, the volume of which corresponds to at least double the volume of a dirty water tank. Furthermore, the storage truck can additionally also store at least one battery such that, where required, it is possible to exchange the battery on the scrubber-drier machine without a great deal of effort and expense. As a result, it is also possible to treat larger floor areas in a time-saving and cost-saving manner. As a result of the storage truck it is possible to keep the volume of the fresh water and dirty water tanks of the wet cleaning machine small so as to make it possible for one operator to operate in a simple and energy-saving manner. As a result of at least one, preferably several fresh water tanks being stored filled on the storage truck, a quick changeover is able to be carried out. The storage truck is preferably positioned in the vicinity of the floor treatment device during a corresponding operating period or is entrained which means that it is also possible to empty or exchange a dirty water tank in a simple manner without a corresponding emptying or exchanging operation having to be carried out at a stationary location in a corresponding building in which the floor treatment is performed. The storage truck can also be provided with a holder for receiving or attaching the scrubber-drier machine such that the scrubber-drier machine is able to be transported on or in the storage truck.

Further details and features of the invention are produced from the claims as well as from the following description of preferred exemplary embodiments of the invention which are shown by way of the drawings.

BRIEF DESCRIPTION OF THE DRAWINGS

FIGS. 9 to 13 show various operating positions of the scrubber-drier machine according to FIGS. 6 to 8.

DETAILED DESCRIPTION OF THE DRAWINGS

Figure 4:
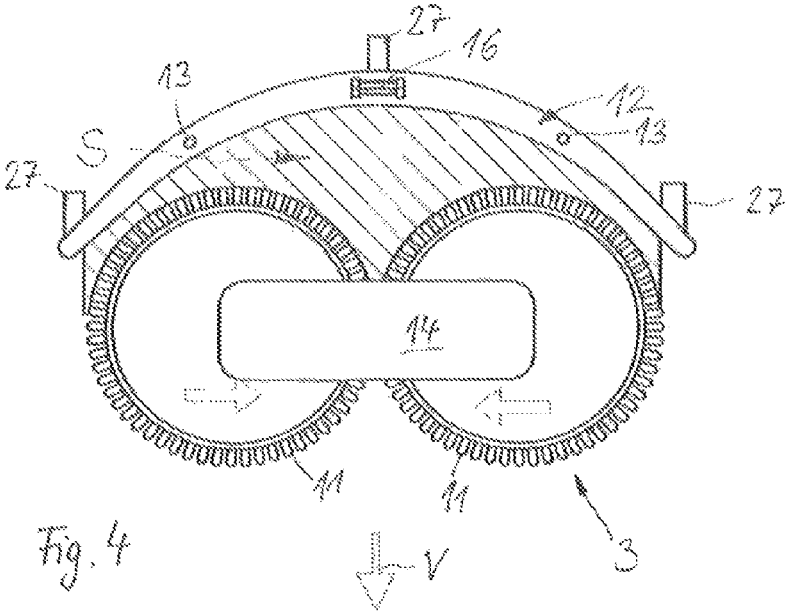
FIG. 4 shows a schematic top view from above of the bottom part according to FIG. 3.
Figure 5:
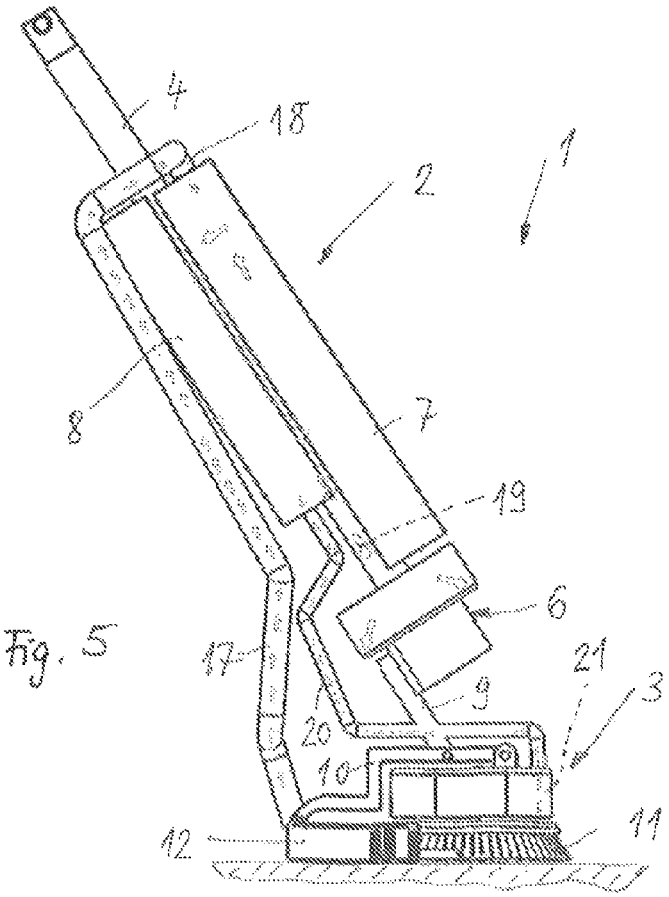
FIG. 5 shows the scrubber-drier machine according to FIG. 1 with supplementary schematic representation of a suction system for supplying fresh water and discharging dirty water.

A scrubber-drier machine according to FIGS. 1 to 16 represents a hand-guided floor treatment device in terms of the invention. The scrubber-drier machine 1 serves for wet cleaning floors in buildings. The scrubber-drier machine 1 comprises a guide part 2 as well as a bottom part 3, both of which are connected together by means of an articulated arrangement 9 which is described in more detail below. The guide part 2 is elongated and projects upward from the bottom part 3. The guide part 2 includes a central, dimensionally stable support tube 4, on the top end face region of which are fastened two handles 5 which protrude on opposite sides. A control block 22 (see FIG. 7), which is also fixedly connected to the top end face region of the support tube 4, is provided between the handles 5. A suction drive 6 of a suction system which is described below in more detail by way of FIG. 5 is fastened on a bottom end region of the support tube 4. The suction drive 6 includes an electrically operated suction turbine. The suction drive 6 forms the bottom end of the guide part 2. The handles 5 with the control block 22 form the top end of the guide part 2. A dirty water tank 7 and a fresh water tank 8 are releasably fastened to the support tube 4 above the suction drive 6. Both the dirty water tank 7 and the fresh water tank 8 are held on the support tube 4 in each case by means of a quick change system and can be removed, exchanged or fastened to the support tube 4 again without tools.

The guide part 2 is pivotally connected to the articulated arrangement 9 by means of an upper articulated axis $G_1$. The articulated arrangement 9, in turn, is pivotally mounted on the bottom part 3 by means of a lower articulated axis $G_2$.

Figures 6, 7, 8:
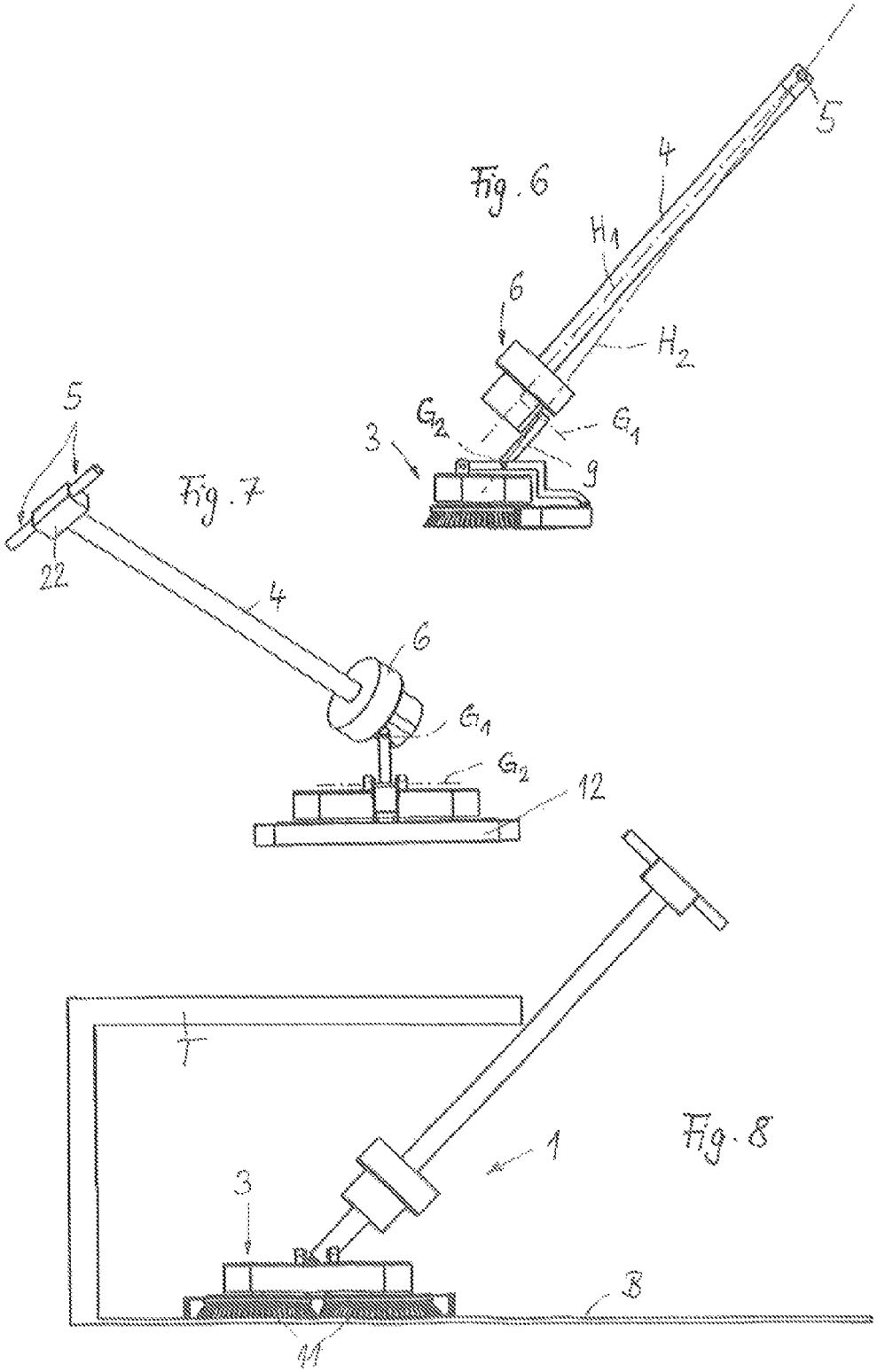
FIG. 6 shows a further view of a schematic representation of the scrubber-drier machine according to FIG. 1, leaving out the fresh water and dirty water tanks.
FIG. 7 shows the scrubber-drier machine according to FIG. 6 in a further operating position.
FIG. 8 shows a schematic representation of the scrubber-drier machine according to FIGS. 6 and 7 in an operating position on a floor underneath a table.

As can be seen by way of FIG. 6, the support tube 4 of the guide part 2 extends coaxially with respect to a vertical axis $H_1$ of the guide part 2. The suction drive 6, which includes the electric suction turbine and a correspondingly dimensionally stable suction housing, is also fastened co-axially with respect to the vertical axis $H_1$ on the bottom end face region of the support tube 4. The suction housing is a load-bearing component on which the articulated arrangement 9 is pivotally mounted. The articulated arrangement 9, as can be seen by way of FIG. 2, includes a dimensionally stable carrier web which is mounted on the bottom part 3 so as to be pivotable about the lower articulated axis $G_2$. The carrier web is connected to a carrier portion of the guide part 2, in particular to a continuation of the support tube 4 or to a carrier portion of the intake housing of the suction drive 6, in a pivotable manner by means of the upper articulated axis $G_1$. The carrier web of the articulated arrangement 9 extends in a parallel plane to a pivot plane of the guide part 2 which receives the vertical axis $H_1$, inside which the guide part 2, according to FIG. 2, is mounted on the carrier web of the articulated arrangement 9 so as to be pivotable about the articulated axis $G_1$. The upper articulated axis $G_1$ is aligned orthogonally with respect to the vertical axis $H_1$ of the guide part 2. The lower articulated axis $G_2$ is aligned orthogonally with respect to the upper articulated axis $G_1$ and orthogonally with respect to the vertical axis $H_1$ as long as the guide part 2 protrudes upward in a straight-line extension with respect to the carrier web of the articulated arrangement 9. In the normal operating position of the bottom part 3 according to FIGS. 1, 6, 7, the articulated axis $G_2$ extends parallel to a floor B on which the bottom part 3 rests in an operating position. Both the upper articulated axis $G_1$ and the bottom articulated axis $G_2$ define pure pivot joints each with two rotational degrees of freedom.

The bottom part 3 comprises two plate-shaped rotatable tools 11 which are realized as plate-shaped brushing tools. The two tools 11 are rotatably mounted in a bearing housing 14 of the bottom part 3, both tools 11 being mounted in the bearing housing 14 so as to be rotatable in each case about an axis of rotation which extends substantially vertically—with reference to the operating position of the bottom part 3 according to the FIG. 1. The bearing housing 14 includes a rotary drive for each tool 11. In the exemplary embodiment shown, the two rotary drives are formed by two electric motors in a manner that is not shown in any more detail. In the case of an embodiment of the invention that is not shown, there is provided one single, central drive motor which rotates the two tools synchronously in opposite directions by means of suitable gearing. A rotary drive can also be formed by an internal combustion engine or by a hydraulic motor.

The bottom part 3 comprises furthermore a suction strip arrangement 12 which also stands on the floor B like the tools 11. The suction strip arrangement 12 is curved in an arcuate manner and, as can be seen by way of FIG. 4, extends slightly beyond a treatment width of the tools 11 on opposite sides. The suction strip arrangement 12 includes two sealing lips D which extend over the entire length of the suction strip arrangement 12 and are spaced apart from one another in order to create an intake slot which is defined over the entire length of the suction strip arrangement 12 between the sealing lips D. Furthermore, the suction strip arrangement 12 has associated therewith centrally an intake 16 which is part of the suction system which is described in more detail below.

Figure 3:
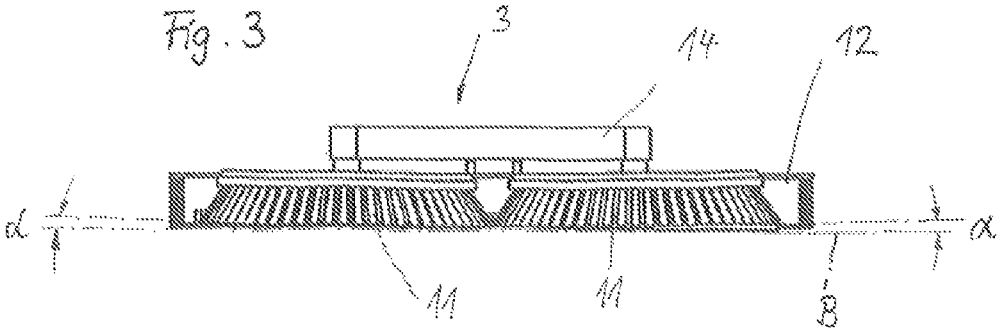
FIG. 3 shows a schematic front view of a bottom part of the scrubber-drier machine according to FIGS. 1 and 2.

As can be seen by way of FIG. 3, the two tools 11 are tilted downward slightly toward the centre in each case by an angle $\alpha$ inside the bearing housing 14 and are rotatably mounted in said inclined position. The permanent inclined position of the adjacent tools 11 is mirror-symmetrical to a vertical centre longitudinal plane of the bottom part 3 such that the set angles $\alpha$ according to FIG. 3 are of identical amounts. As can be seen by way of FIG. 4, the tools are additionally driven in opposite directions to one another when the scrubber-drier machine 1 is operating (see arrows in FIG. 4). In the top view shown in FIG. 4, the left-hand tool 11 rotates anticlockwise, the right-hand tool 11, in contrast, clockwise. With the scrubber-drier machine 1 in operation, the two tools 11 are operated in a synchronized manner at the same amount of speed. As a result of the equally mirror-symmetrical inclination of the tools 11, when the tools 11 are rotating, linear propulsion V (see arrow representation in FIG. 4), which moves the bottom part 3 in a straight line in the direction of propulsion V, is consequently generated permanently on the bottom part 3. The suction strip arrangement 12 is dragged behind the bearing housing 14 and is accordingly inevitably following up. With the bottom part 3 in the operating position, the suction strip arrangement 12 is consequently situated permanently behind the rotating tools 11—with reference to the direction of propulsion V.

Both the at least one rotary drive and the suction drive 6 are controlled by means of the control block 22 between the handles 5 on the guide part 2. To this end, corresponding adjusting and switching elements are provided on the control block 22. Both the rotary drive and the suction drive 6 are electrically powered by means of a battery A which is shown in a schematic manner in FIG. 1. The battery A is fastened on a carrier bridge 10 of the bottom part 3 which connects the suction strip arrangement 12 to the bearing housing 14 of the bottom part 3. In this case, the carrier bridge 10 is coupled with the bearing housing 14 at a front end face region—with reference to the direction of propulsion V—by means of a pivot joint 15. At a rear end face region the carrier bridge 10 is pivotally mounted on the suction strip arrangement 12 by means of a further pivot joint unit 13. The pivot axes of the two pivot joints 13 and 15 are aligned parallel to one another and parallel to the lower articulated axis $G_2$. The pivot joint unit 13 includes two coupling points on the suction strip arrangement 12 which have a common pivot axis and distribute force uniformly to the suction strip arrangement 12 (FIG. 4). The two coupling points of the pivot joint unit 13 are provided on opposite sides of the intake 16 which is positioned centrally in the suction strip arrangement 12.

The suction strip arrangement 12 rests uniformly and consistently on the floor B by way of its sealing lips D over the entire length of the suction strip arrangement 12 and consequently over the entire treatment width of the bottom part 3. Furthermore, the suction strip arrangement 12 has associated therewith several floor spacers 27 which are arranged distributed over the length of the suction strip arrangement 12 (FIG. 4). The floor spacers 27 prevent the sealing lips D being bent and compressed too strongly by bringing about support on the floor B in addition to the sealing lips D. Several rolling or sliding elements, which are arranged distributed over the length of the suction strip arrangement 12, bring about additional support of the suction strip arrangement 12 on the floor B and ensure uniform bending and curving of a rear sealing lip of the suction strip arrangement 12, are provided as floor spacers 27.

The suction strip arrangement 12 comprises an arcuately curved carrier beam in which the intake 16 is provided. The carrier beam is developed in a dimensionally stable manner. The two sealing lips, which extend over the entire length of the suction strip arrangement 12, are provided on an underside of the carrier beam, a front sealing lip in the direction of propulsion being provided with openings or recesses for receiving the dirty water in the suction chamber between the rear sealing lip and the front sealing lip. The rear sealing lip is developed from an elastomer material and, in the operating position of the scrubber-drier machine as well as in the operating position of the bottom part 3, rests consistently on the floor B over its entire length. In this case, it is bent round, i.e. curved, rearward by a certain angle. The floor spacers 27, which are fastened behind the sealing lip on the carrier beam of the suction strip arrangement 12, are provided in order to ensure that said angle is not altered. In the case of the embodiment according to FIG. 4, the floor spacers 27 are realized as sliding elements which, with the sealing lip bent round rearwardly at the defined angle, are supported on the floor B and thus prevent the carrier beam and the suction strip arrangement 12 from sinking down further.

In the case of an embodiment of the invention which is not shown, the front sealing lip of the suction strip arrangement serves as a floor spacer by being developed from a substantially dimensionally stable sliding material and taking over the support of the suction strip arrangement and of the carrier beam on the floor. Additional rolling or sliding elements are not required in the case of said embodiment. The at least substantially dimensionally stable front sealing lip serves for supporting and aligning the rear curved sealing lip at the defined angle.

As can be seen by way of FIG. 5, a dirty water suction line 17, which opens out into the dirty water tank 7 by means of a supply connecting piece 18 in the region of a top surface of the said dirty water tank, is connected to the intake 16. A flow channel, which is indicated by way of the reference 19 and forms a suction channel for generating negative pressure in the dirty water tank 7, is incorporated in the support tube 4. The suction channel 19 opens out into the suction drive 6. When the suction drive 6 starts, air is sucked out of the dirty water tank 2 into the suction channel 19 by means of a corresponding intake opening between the support tube 4 and the dirty water tank 7, as a result of which negative pressure, which generates the desired suction action for sucking up dirty water in the region of the suction strip arrangement 12, is generated in the dirty water tank 7. The supply connecting piece 18 is guided into the dirty water tank 7 by an amount that ensures that no dirty water is able to pass into the suction channel 19 in the support tube 4 by means of the intake opening for generating the negative pressure. A shape of the dirty water tank 7 is chosen in such a manner that even when the guide part 2 is in the horizontal position, it is not possible for dirty water to pass into the intake opening and the suction channel 19.

Proceeding from the fresh water tank 8, a fresh water line 20, which opens put into a supply connecting piece 21 via which the fresh water is supplied to the treatment region of the tools 11, is additionally guided to the bottom part 3 as a fresh water supply system. Fresh water can be tap water with or without cleaning additives. As an alternative to this, fresh water is also to be understood as a non-water-based cleaning solution.

When the scrubber-drier machine 1 is operating, the tools 11 according to FIG. 4 rotate on the floor and clean it together with the supplied fresh water. In this case, in addition the tools 11 are permanently moved in a linear manner in the direction of propulsion V. A dirty water detergent solution S is accordingly collected in an inevitable manner—when seen in the direction of propulsion V—behind the rotating tools 11 and is sucked up by the suction strip arrangement 12. The lines for dirty water and fresh water described beforehand are developed in a flexible manner at least in portions in order to follow corresponding pivoting movements of the guide part 2 in relation to the bottom part 3 without making the suction system and the fresh water supply system inoperative.

As can be seen by way of FIGS. 6 to 13, the guide part 2 is freely pivotable in all directions in relation to the bottom part 3 by means of the articulated arrangement 9. As a result of the two mechanically defined pivot joints in the region of the upper articulated axis $G_1$ and the lower articulated axis $G_2$, in each pivot position of the guide part 2 a corresponding torque is also transmitted to the bottom part 3, said torque having been introduced into the guide part 2 as a result of a rotation of the guide part about a vertical axis $H_2$ (FIG. 6) by means of a corresponding rotational load on the handles 5 by an operator. By way of FIG. 9 the scrubber-drier machine 1 is shown being guided in a straight-line extended in the direction of propulsion V, where an operator walks behind the guide part 2 and holds the handles 5 in the straight-on position. FIG. 10 shows that the operator is able to walk laterally offset to the bottom part 3 such that the guide part 2 is correspondingly pivoted inclinedly to the rear and to the side and nevertheless the straight-line propulsion of the bottom part 3 remains ensured. In the representation according to FIG. 11, the operator walks in front of the bottom part 3 in the direction of propulsion V. Accordingly, the guide part 2 is pivoted forward in relation to the bottom part 3. In the case of the representation according to FIG. 12, the operator has exerted a rotational movement on the bottom part 3 by means of the guide part 2 and the handles 5 in order to bring about a change in the direction of the bottom part 3. In FIG. 13, the bottom part 3 is automatically moved inclinedly along a boundary edge of a wall W. By showing the guide part 2 with broken lines, it can be seen that the guide part is able to be guided in different pivot positions in relation to the bottom part 3 in order to control the desired movement of the bottom part 3. It can be seen in FIG. 1 how the scrubber-drier machine 1, initially directed forward according to FIG. 9, is controlled under a table 9, then by means of a corresponding rotation of the guide part 2 analogous to FIG. 12 is guided into the position shown in FIG. 8 and finally as a result of rotating the guide part 2 again according to FIG. 11 is able to be guided out again from under the table T. The operator does not need to exert any pushing or pulling forces in the case of all said operations as the automatic propulsion of the bottom part 3 inevitably performs the forward movement of the bottom part 3.

Figure 1:
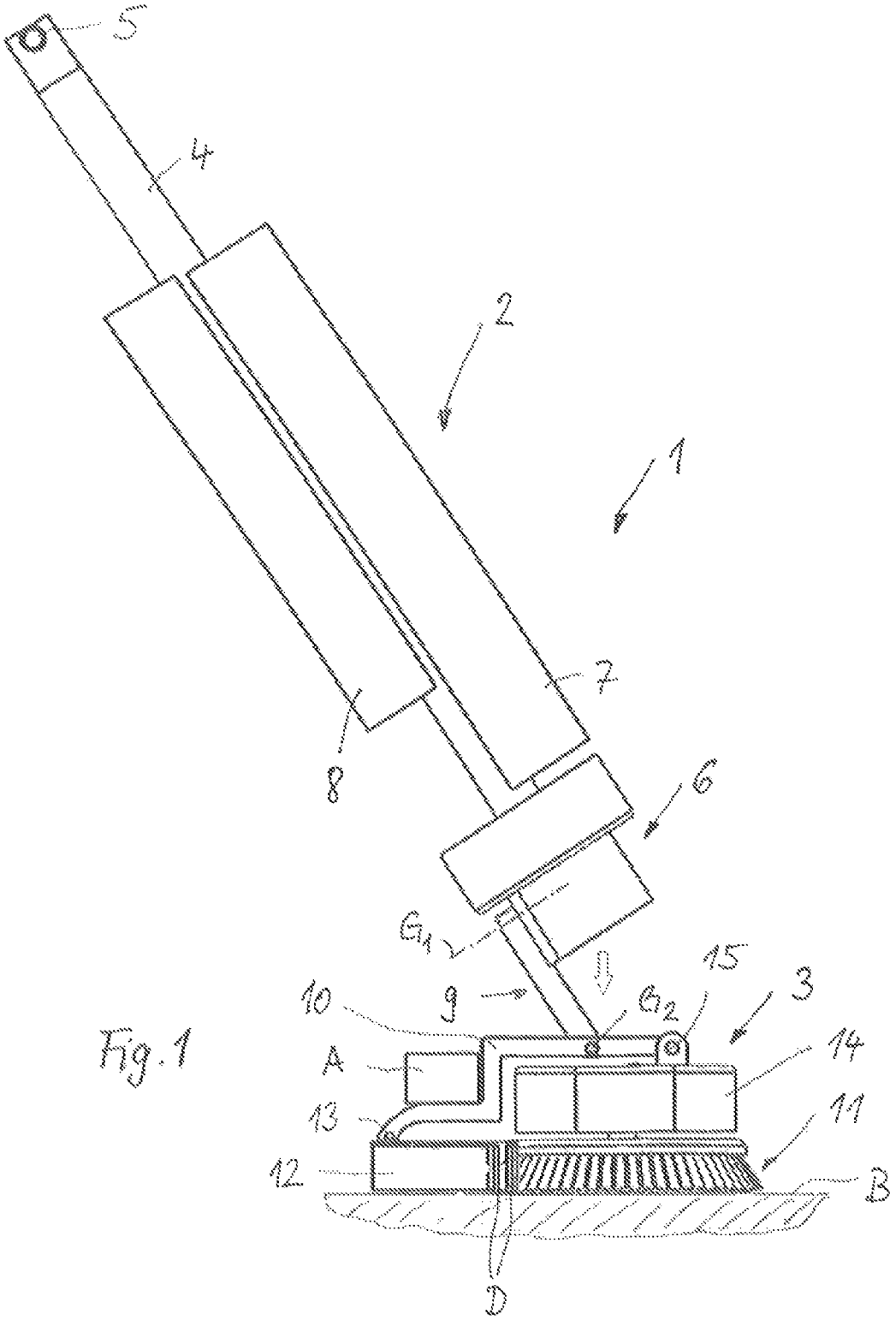
FIG. 1 shows a schematic representation of an embodiment of a hand-guided floor treatment device according to the invention in the form of a scrubber-drier machine.
Figure 2:
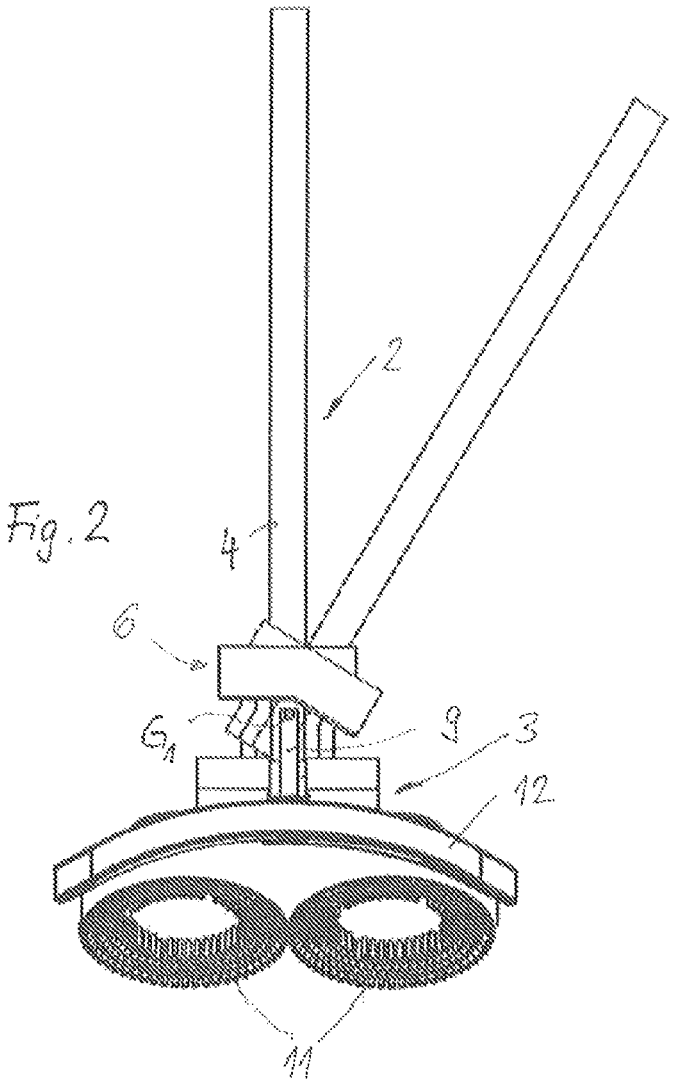
FIG. 2 shows a view inclinedly from behind and from below of a schematic representation of the scrubber-drier machine according to FIG. 1.

It can be seen by way of FIG. 1 that the suction drive 6 extends toward the lower articulated axis $G_2$ in part parallel to the carrier web of the articulated arrangement 9. In addition, the suction drive 6 is positioned in front of the carrier web of the articulated arrangement 9. On account of the relatively heavy weight of the suction drive 6, a mass centre of gravity of the guide part 2 with the guide part 2 in the inclined position shown is shifted relatively far downward to the upper articulated axis $G_1$. In an elongated manner and on opposite sides, the dirty water tank 7 and the fresh water tank 8 additionally nestle closely against the support tube 4. Consequently, a large part of the weight of the guide part 2 in the region of the articulated axis $G_1$ is received by the articulated arrangement 9 and introduced into the bottom part 3. This means that in the alignment of the guide part 2 shown in FIG. 1, a holding and guiding force for an operator in the region of the handles 5 is extremely small. The guide part 2 is accordingly movable without any greater expenditure of force in order to control the bottom part 3.

With the scrubber-drier machine 1 in the operating position, the bottom part 3 is supported on the floor B exclusively by means of the two tools 11 on the one side and the suction strip arrangement 12 on the other. As the guide part 2 is supported, in turn, on the bottom part 3 by means of the articulated arrangement 9, the overall weight of the scrubber-drier machine 1 is supported in the region of the supporting of the tools 11 on the floor B by means of a front support and in the region of the supporting of the sealing lips D on the floor B by means of a rear support. A working region of the articulated arrangement 9 on the bottom part 3, which is defined by the lower articulated axis $G_2$ on the carrier bridge 10, is chosen such that the overall weight of the scrubber-drier machine 1 is distributed uniformly onto the front support in the region of the tools 11 and the rear support in the region of the suction strip arrangement 12. Depending on the position of the operating region, the weight can be distributed in a front-heavy manner in the direction toward the tools 11 instead of being distributed uniformly.

Figure 14:
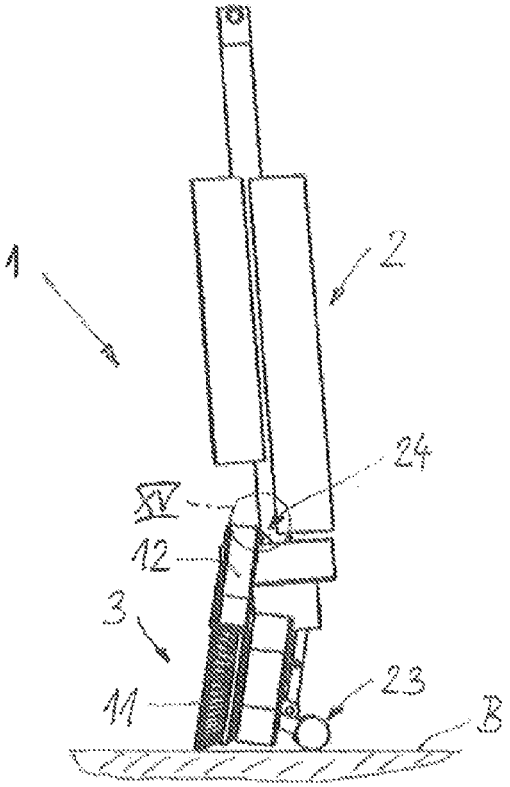
FIG. 14 shows the scrubber-drier machine according to FIGS. 1 to 13 in a parked storage position.
Figure 15:
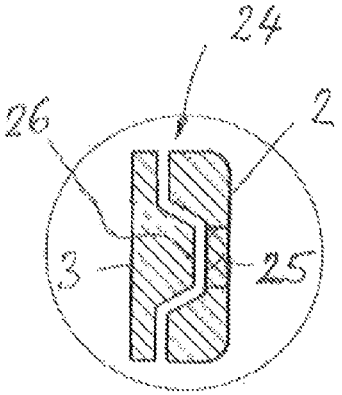
FIG. 15 shows an enlarged sectioned representation of a detail XV of the scrubber-drier machine according to FIG. 14.
Figure 16:
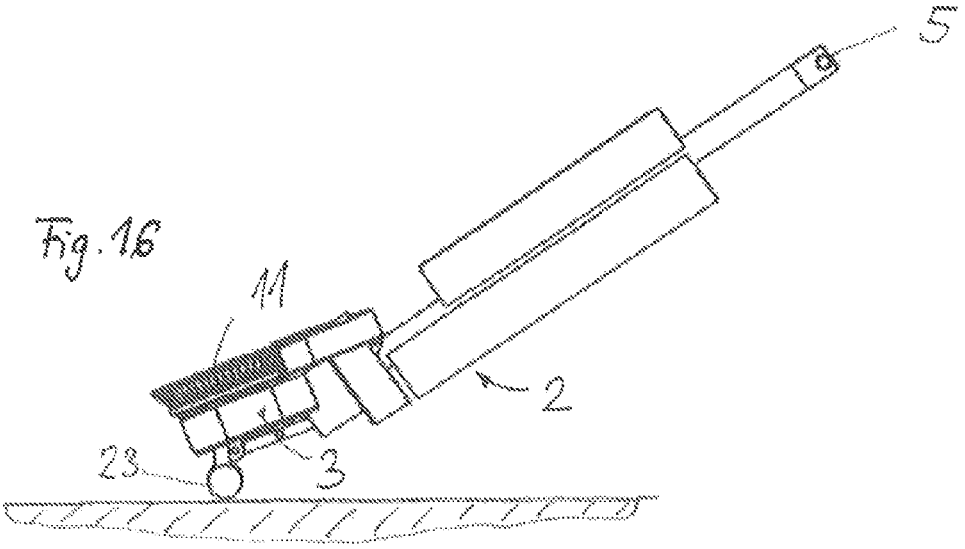
FIG. 16 shows the scrubber-drier machine according to FIG. 14 in a transport position.

As can be seen by way of FIGS. 14 to 16, the scrubber-drier machine 1 can be parked in a storage position which defines a position of non-use for the scrubber-drier machine 1. In this case, the bottom part 3 is tilted upward over its front edge which is defined by the front edges of the rotatable tools 11. A support means in the form of a support roller 23, on which the bottom part 3 is supported in the storage position according to FIG. 14, is arranged in the region of an upper surface of the bearing housing 14. The bottom part 3 is tilted by such an amount that in said storage position a statically stable support is produced by means of the front edge of the tools 11 on the one side and the support roller 23 on the other side. Instead of a single centrally arranged support roller 23, it is also possible to provide several support rollers which are arranged side by side spaced apart in parallel. For the storage position that corresponds to the position of non-use, the guide part 2 is also pivoted in relation to the parked bottom part 3 beyond a vertical until securing means 25, 26 between the bottom part 3 and the guide part 2 come to abut against one another in a positive locking manner. The guide part 2, in the case of the embodiment according to FIG. 14, is positioned in said position in an over-centre position in relation to the bottom part 3 such that the centre of gravity of the guide part 2 is situated in a stable manner above the bottom part 3. A permanent magnet 25, with which a corresponding magnetizable face 26 on the bottom part 3 is associated, is provided on the guide part 2 as securing means. As a result of the pivoting movement of the guide part 2 in relation to the bottom part 3 which is already parked in position, the permanent magnet 25 and the magnetizable face 26 move to abut against one another and bring about a securement of the guide part 2 on the bottom part 3 which is limited by magnetic force. The magnetic force securement can be neutralized in a simple manner as a result of pivoting the guide part 2 about the articulated axis $G_1$ by the guide part 2, according to the representation in FIG. 14, being pivoted out of the drawing plane in an orthogonal manner. In this case, the faces of the permanent magnet 25 and of the magnetizable face 26 which face one another slide laterally past one another. Said movement is made possible without any great expenditure of force as the magnetic force acts perpendicularly between the adjacent faces of the magnetic securement, not however parallel to same. It can be seen by way of FIG. 16 that the scrubber-drier machine 1 is also able to be transported in a simple manner in said securing position shown in FIG. 14 by the scrubber-drier machine 1 being tilted forward manually onto the at least one support roller 23 and then being pulled or pushed by means of the handles 5.

Figure 17:
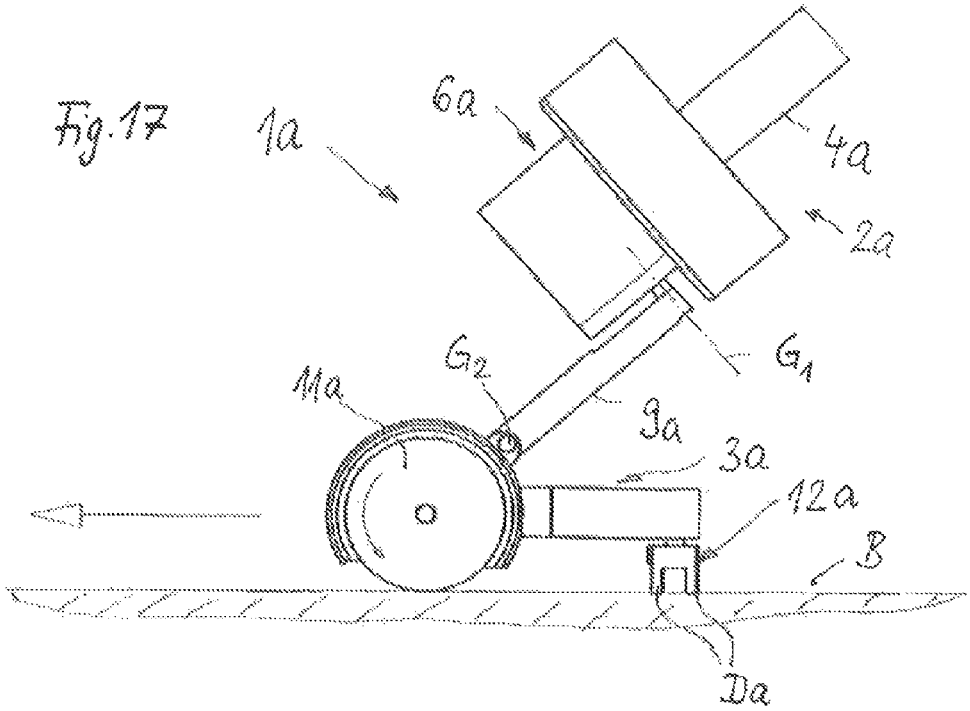
FIG. 17 shows a side view of a schematic representation of a further embodiment of a scrubber-drier machine according to the invention and FIG. 18 shows a top view of the scrubber-drier machine according to FIG. 17.
Figure 18:
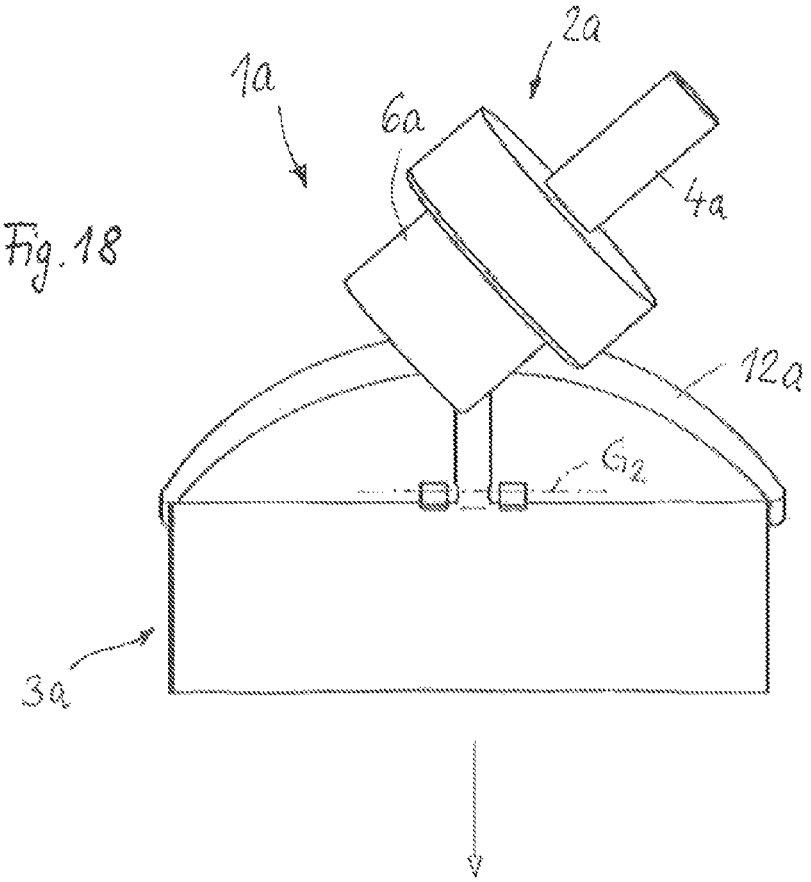

The scrubber-drier machine 1*a* according to FIGS. 17 and 18 comprises, in principle, the same design as the scrubber-drier machine 1 described in detail beforehand by way of FIGS. 1 to 16. Operatively identical parts and portions are provided with the same references with the addition of the letter a. Only the differences between the scrubber-drier machine 1*a* and the scrubber-drier machine 1 described beforehand will be gone into below in order to avoid repetition. In addition, reference is made to the disclosure with regard to the embodiment according to FIGS. 1 to 16. The essential difference in the case of the scrubber-drier machine 1*a* according to FIGS. 17 and 18 is that instead of plate-shaped rotatable tools 11, one single, roller-shaped rotatable tool 11*a* is provided which, with the scrubber-drier machine 1*a* in the operating position, is mounted in the bottom part 3*a* with an axis of rotation that is aligned parallel to the floor B. The tool 11*a* is provided with one single electric rotary drive that is not shown in any more detail. The tool 11*a* is drivable simply in one direction of rotation in which permanent propulsion in the direction of the arrow (see FIGS. 17 and 18) is achieved for the bottom part 3*a*. The direction of rotation of the tool 11*a* is also shown in FIG. 17 by a circular arc-shaped arrow. Fresh water is supplied in the region of the tool 11*a* in an analogous manner to the scrubber-drier machine 1 according to FIGS. 1 to 16. The dirty water is sucked up in the same manner in the case of the suction strip arrangement 12*a* by means of the suction and sealing lips Da, as has been described beforehand.

The two sealing lips D, Da of each suction strip arrangement 12, 12*a* are developed in the case of the two embodiments according to FIGS. 1 to 18 such that a front sealing lip is interrupted or permeable in order to enable the dirty water detergent solution to be sucked up, whereas a rear sealing lip prevents the dirty water detergent solution remaining on the floor.

The invention claimed is:

1. A hand-guided floor treatment device, comprising:

a bottom part which includes two tools which are rotatable on a floor by way of a drive;

a guide part which includes at least one handle and is connected to the bottom part by an articulated arrangement configured such that the guide part, proceeding from a perpendicular, is pivotable in relation to the perpendicular in angular positions rotating in all directions and is operatively connected to the bottom part so as to transmit torque in an angularly limited manner in each angular position in relation to the perpendicular, wherein the two rotatable tools are arranged on the bottom part and have an approximately vertical axis of rotation, the two tools being slightly inclined with respect to a horizontal plane such that when the floor treatment device is operating, the two rotatable tools exert permanent linear propulsion on the bottom part as a result of uneven rotational friction of each tool on the floor, the floor treatment device is a wet cleaning machine, and comprises a suction strip arrangement which—when viewed in the direction of propulsion—is arranged behind the two rotatable tools and in operation rests on the floor, and a suction drive for the suction strip arrangement is incorporated in the guide part and is developed as a bottom operational portion of the guide part.

2. The floor treatment device according to claim 1, wherein the articulated arrangement includes at least two articulated axes which differ from one another, are in particular orthogonal to one another, and are aligned in each case differently, in particular orthogonally with respect to a vertical axis of the guide part.

3. The floor treatment device according to claim 2, wherein the at least two articulated axes are spaced apart from one another in the direction of the vertical axis of the guide part.

4. The floor treatment device according to claim 3, wherein weight distribution of the guide part is displaced downward toward the upper articulated axis, and further wherein a mass center of gravity of the guide part in the standby state is arranged in the region of an upper articulated axis or below the upper articulated axis.

5. The floor treatment device according to claim 4, wherein a bottom operational portion of the guide part flanks the articulated arrangement at least in part.

6. The floor treatment device according to claim 1, wherein in the normal operating position the bottom part is supported on the floor—when viewed in the direction of propulsion—at the front by the two rotatable tools and at the rear by the suction strip arrangement, and further wherein the articulated arrangement is pivotally mounted in a working region on the bottom part in such a manner that an overall weight of the floor treatment device is distributed in a uniform or front-heavy manner onto the front and the rear support of the bottom part on the floor.

7. The floor treatment device according to claim 6, wherein the working region of the articulated arrangement on the bottom part is adjustable forwards or rearwards—when viewed in the direction of propulsion of the bottom part.

8. The floor treatment device according to claim 1, wherein the suction strip arrangement has associated therewith at least one floor spacer which, in addition to at least one sealing lip of the suction strip arrangement, brings about support of the bottom part on the floor.

9. The floor treatment device according to claim 1, wherein a flow channel which is associated with a suction system for the suction strip arrangement is arranged in the guide part coaxially or parallel to the vertical axis of the guide part.

10. The floor treatment device according to claim 9, wherein the guide part includes a support tube which extends along the vertical axis and in which the flow channel is incorporated.

11. The floor treatment device according to claim 10, wherein the suction drive is arranged on a lower end region of the support tube.

12. The floor treatment device according to claim 11, wherein fresh water and dirty water tanks of the suction system are developed in an elongated manner and flank the support tube on opposite sides.

13. The floor treatment device according to claim 1, wherein provided on the bottom part is at least one support which supports the bottom part on the floor statically determined in a tilted transport or storage position.

14. The floor treatment device according to claim 13, wherein the at least one support is configured as a support moveable in a sliding or rolling manner.

15. A floor treatment system, comprising:

a hand-guided floor treatment device according to claim 1;

a storage truck, which includes at least one exchangeable and filled fresh water tank as well as at least one receiver for a filled dirty water tank and/or a dirty water receiving vessel, the volume of which corresponds to at least double the volume of the dirty water tank.

16. The floor treatment device according to claim 1, wherein the two tools are plate shaped and are inclined by identical angular amounts in a mirror-symmetrical manner with respect to a vertical center longitudinal plane of the bottom part and are actuated in opposite directions at synchronized drive speeds in order to obtain the linear propulsion.

17. A hand-guided floor treatment device, comprising:

a bottom part which includes at least one tool which is rotatable on a floor by way of a drive;

a guide part which includes at least one handle and is connected to the bottom part by an articulated arrangement configured such that the guide part, proceeding from a perpendicular, is pivotable in relation to the perpendicular in angular positions rotating in all directions and is operatively connected to the bottom part so as to transmit torque in an angularly limited manner in each angular position in relation to the perpendicular, wherein the at least one rotatable tool is arranged on the bottom part such that when the floor treatment device is operating, the at least one rotatable tool exerts permanent linear propulsion on the bottom part, the floor treatment device is a wet cleaning machine, and comprises a suction strip arrangement which—when viewed in the direction of propulsion—is arranged behind the rotatable tool and in operation rests on the floor, and the bottom part includes a carrier bridge which extends along the direction of propulsion of the bottom part and on which the working region of the articulated arrangement is provided, and which is mounted at the one end on the suction strip arrangement and at the other end in the region of a bearing arrangement of the at least one rotatable tool so as to be pivotable about, in each case, a pivot axis which extends transversely with respect to the direction of propulsion and parallel to the floor.

18. A hand-guided floor treatment device, comprising:

a bottom part which includes at least one tool which is rotatable on a floor by way of a drive;

a guide part which includes at least one handle and is connected to the bottom part by an articulated arrangement configured such that the guide part, proceeding from a perpendicular, is pivotable in relation to the perpendicular in angular positions rotating in all directions and is operatively connected to the bottom part so as to transmit torque in an angularly limited manner in each angular position in relation to the perpendicular, wherein the at least one rotatable tool is arranged on the bottom part such that when the floor treatment device is operating, the at least one rotatable tool exerts permanent linear propulsion on the bottom part, at least one support is provided on the bottom part and supports the bottom art on the floor statically determined in a tilted transport or storage position, and with the bottom part in the transport or storage position, the guide part is secured on the bottom part in a force-limited manner by at least one securing device in an idle position in which the guide part and the bottom part are supported statically determined in relation to one another in particular in an over-center position.

19. The floor treatment device according to claim 18, wherein the at least one securing device is effective in a positive locking or non-positive locking manner, and/or is effective as a result of magnetic force.

* * * * *